US005749403A

United States Patent [19]

Conforti

[11] Patent Number: 5,749,403

[45] Date of Patent: May 12, 1998

[54] PROCESS FOR FILLING CONTAINERS, IN PARTICULAR CANS, WITH LIQUIDS, AND A FILLER VALVE GROUP FOR CARRYING OUT THE PROCESS

[75] Inventor: Lucio Conforti, Fornovo Taro, Italy

[73] Assignee: SASIB Beverage S.p.A., Parma, Italy

[21] Appl. No.: 433,543

[22] Filed: Apr. 26, 1995

Related U.S. Application Data

[63] Continuation of PCT/IT93/00082, Jul. 22, 1993.

[30] Foreign Application Priority Data

| | | | |
|---|---|---|---|
| Oct. 30, 1992 | [IT] | Italy | PR92A0046 |
| Apr. 16, 1993 | [IT] | Italy | PR93A0014 |

[51] Int. Cl.[6] ..... B65B 1/104

[52] U.S. Cl. ..... 141/276; 141/39; 141/47; 141/147

[58] Field of Search ..... 141/39, 40, 45, 141/47, 48, 49, 50, 266, 270, 275, 276, 277, 278, 281, 142, 147–150, 145, 144, 172, 301, 368, 6, 2

[56] References Cited

U.S. PATENT DOCUMENTS

| | | | |
|---|---|---|---|
| 2,325,419 | 7/1943 | Minard . | |
| 4,938,261 | 7/1990 | Petri et al. | 141/147 |
| 5,139,058 | 8/1992 | Yun | 141/147 |
| 5,161,585 | 11/1992 | Murao et al. | 141/39 |

FOREIGN PATENT DOCUMENTS

| | | |
|---|---|---|
| 0 080 774 | 6/1983 | European Pat. Off. . |
| 0 154 050 | 9/1985 | European Pat. Off. . |
| 0 412 480 | 2/1991 | European Pat. Off. . |
| 0 453 879 A1 | 10/1991 | European Pat. Off. . |
| 22 59 275 | 6/1974 | Germany . |

*Primary Examiner*—Henry J. Recla
*Assistant Examiner*—Steven O. Douglas
*Attorney, Agent, or Firm*—Darby & Darby

[57] ABSTRACT

The device relates to the field of processes and plants for filling cans with liquids, and provides a contemporaneous closure of the liquid and, gas inflow pipes. The device also relates to a filler valve group wherein the pipes are placed at the same level. A cam causes a rising or descent of the cans with respect to the valve group in order to regulate a filling level.

13 Claims, 5 Drawing Sheets

PROCESS FOR FILLING CONTAINERS, IN PARTICULAR CANS, WITH LIQUIDS, AND A FILLER VALVE GROUP FOR CARRYING OUT THE PROCESS

This is a continuation of international application Ser. No. PCT-IT93/00082, filed Jul. 22, 1993.

BACKGROUND OF THE INVENTION

In the field of container liquid filler groups, and especially in the case of can fillers, filler machines with rotating platforms having a plurality of filler valve groups to fill transiting containers are well known. Generally the containers are supported on non-vertically-mobile plates and during the filling phase the valve group descends towards the container, or, as in other prior art realisations, the valve group is fixed and the containers are brought upwards to them by vertically-mobile plates.

In the majority of can filler machines for carbonated liquids, the liquid level in the cans is defined by means of a level-sensing tube, which during the filling phase is partially introduced into the can. The liquid inflow into the can is stopped at the moment when the liquid reaches and closes the lower opening of the tube, causing the gas to flow towards the container tank. Obviously correct and precise dimensioning of the level-sensing tube is important since every millimeter of vertical level in the can corresponds to about three cubic centimeters of liquid.

One drawback of traditional fillers lies in the fact that it is difficult to maintain level precision over a long period of time, as accuracy can be compromised by accidental impacts between the level-sensing tube and the can at the inlet and outlet zones of the machine. The tube support in the filler valve is indeed small since its size is conditioned by the passage section of the liquid, which must be as large as possible.

A further drawback is the difficulty of sensing tube height regulation when the can shape is changed, or when the filling level required is varied. In prior art filler machines intervention is required on the single valves to effect such a regulation, causing hold-ups and loss of time, as is shown for example in International Patent Application WO 90/08727.

A further drawback in traditional valves is the fact that uncontrolled variation in the liquid level occurs, and therefore the quantity of the contents in the can changes, caused by variations of pressure and/or product level in the tank. When the liquid closes the level-sensing tube in the can, some pressurised gas remains trapped between the valve body and the surface of the liquid so that if in the meantime the pressure in the tank increases, even by a few tenths of a bar, the liquid is pushed into the can in order to reestablish the isobar equilibrium between the tank and the can, causing an undesired increase in the contents of liquid in the can.

This phenomenon is particularly relevant when the filler machine halts while there are containers actually in the filling phase: traditional filler machines in such conditions tend to fill the containers almost to the top.

In order to limit the above-mentioned drawbacks, conventional filler machines have, on the path of the liquid, syphons, nets or small holes, which however make the valve group considerably more complex and difficult to clean and sterilise, and which do not in any case fully solve the problem. One realisation in particular, illustrated in DE Pat. Appln. N. 2 120 554, envisages the use of a tube surrounded by a sort of float with which it can run vertically for a tract internally to the valve group so as to permit the closure of the liquid inlet pipe.

In reality, apart from the complexity of the device, when the liquid reaches the lower end of the tube, closing the gas pipe, the liquid pipe stays open and, with the outflow of the residual liquid from the pipe the level of the liquid in the container rises, causing a similar raising of the level sensing tube together with the float, up until the float completely closes the liquid inlet pipe. But, since the closure is caused by the inflow of liquid, it follows that the more the inflow pipe is obstructed by the float, the slower the rising of the float will be, and final closure is thus delayed.

Document DE 2 042 990 shows a filler valve group equipped with a height-mobile centering element externally to the valve and solid to the level-sensing tube. This document does not, however, teach how to solve the above-mentioned problems connected with the presence of the level sensing tube.

U.S. Pat. No. 4,986,318 and EP-A-0 154 050 show a filling valve for counterpressure filling of cans in which during the liquid filling phase when the gas valve and the liquid valve are open, the inferior end of the gas pipe is at a higher level than the inferior end of the liquid pipe.

According to these two documents the seal between the valve and the can is obtained by means of two ring gaskets or "O-rings" which are concentric and superposed one on the other, and wherein there is a final decompression due to increased volume inside the can due to the extraction of the can at the end of the filling operation.

This decompression, however, is not guaranteed by the O-rings, which are subject to frequent stress during the entrance and exit of the cans for each filling operation, causing rapid wear and tear. Neither do these documents solve the other drawbacks connected with the presence of the level-sensing tube.

U.S. Pat. No. 2,325,419 discloses a liquid filling valve having a vent to allow the air to escape from the container while the liquid flows thereinto. The inflow of liquid into the container stops when the level of the liquid reaches the vent, so that the liquid cannot rise to a level higher than the vent intake.

This document does not show any gas valve and the valve disclosed is not able to fill carbonated liquids (i.e. liquid with gas $CO_2$ added).

SUMMARY OF THE INVENTION

The principal aim of the present invention is to obviate the above-mentioned drawbacks by providing a filling process and a valve group which avoid the use of a level-sensing tube, which are versatile and reliable, and which have a single external command for regulation of the liquid content in the cans.

A further aim is to achieve greater precision in the levels, with a simplification of the valve group and at the same time a shorter filling time and thus greater productivity, and which also reduces foam formation during the decompression phase.

The said aims are all attained in the invention, which is a process of container filling, in particular cans, with liquids, which is characterised as in the claims that follow.

BRIEF DESCRIPTION OF THE DRAWINGS

Further characteristics and advantages of the present invention will better emerge from the detailed description that follows, of an embodiment of the invention, herein illustrated purely in the form of a non-limiting example in the accompanying figures, in which.

DESCRIPTION OF THE PREFERRED EMBODIMENTS

Figure 1:
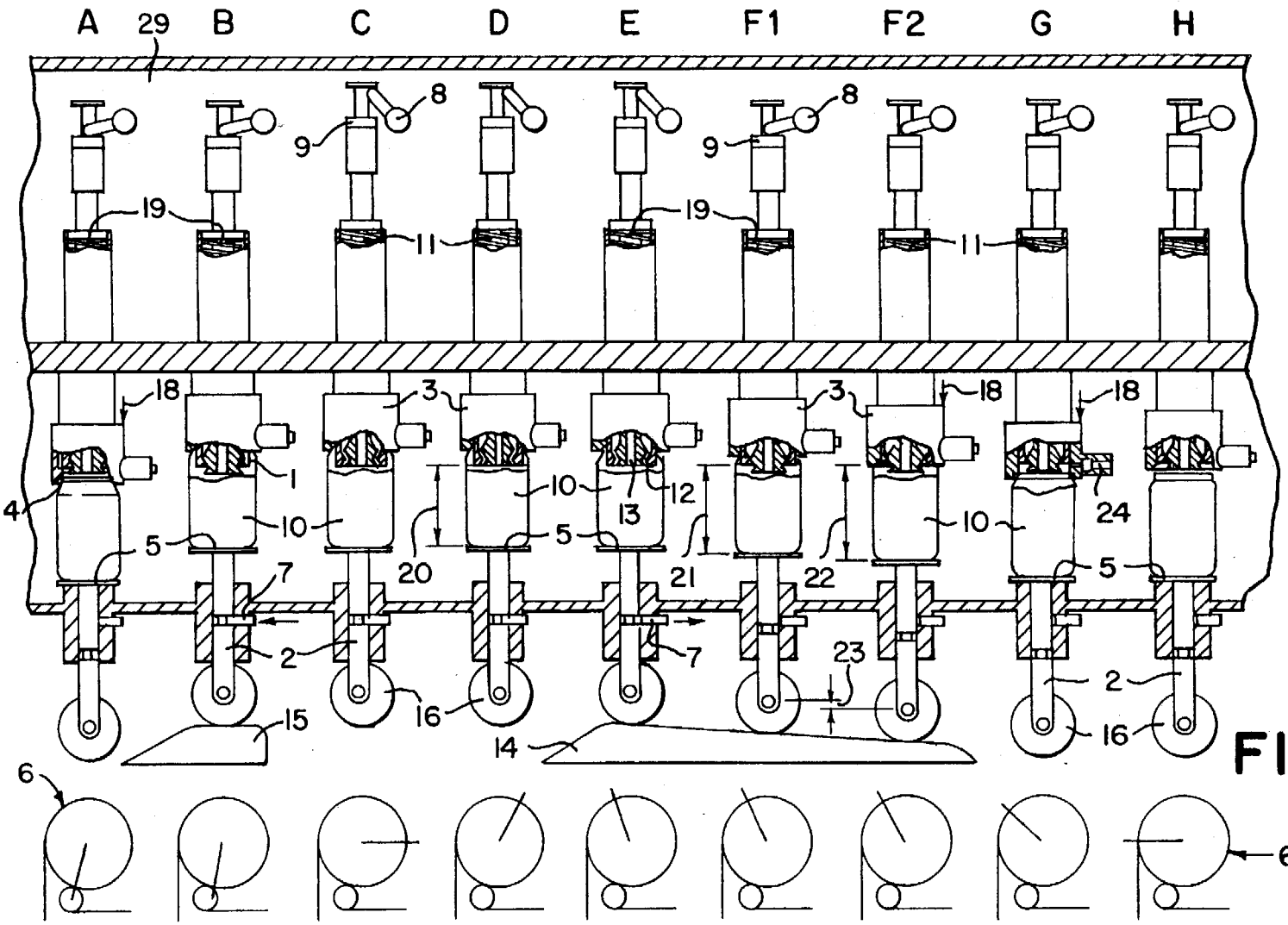
FIG. 1 schematically shows the valve group in the various process phases.
Figure 2:
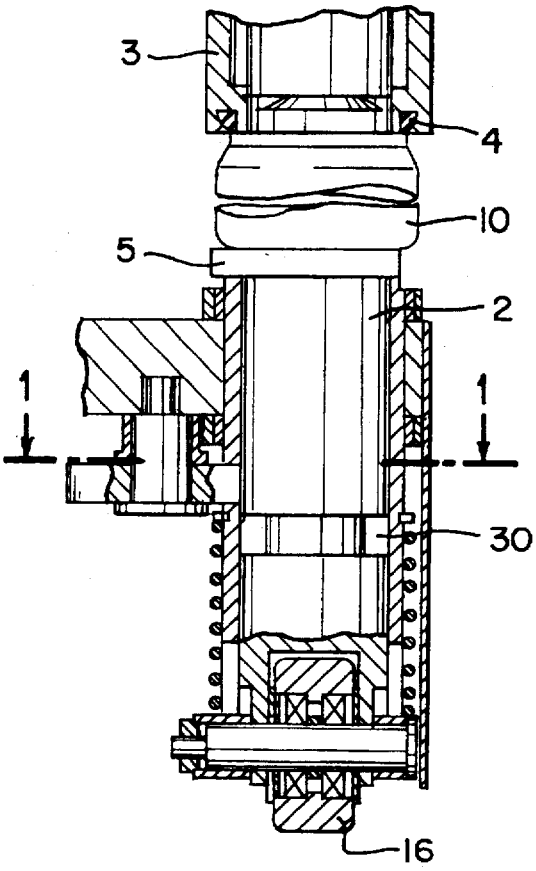
FIGS. 2 and 3 show, in section and in two different operative phases, the container lifting means.
Figure 3:
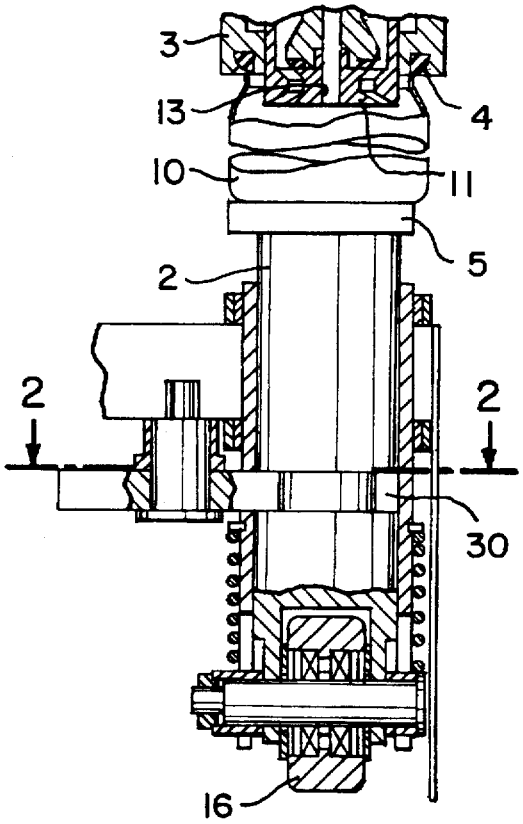
Figure 4:
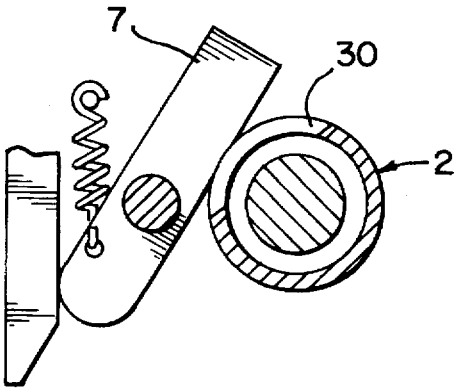
FIGS. 4 and 5 show a detail of the means of FIGS. 2 and 3 in a sectioned view according to line I—I and of FIGS. 2 and 3, respectively.
Figure 5:
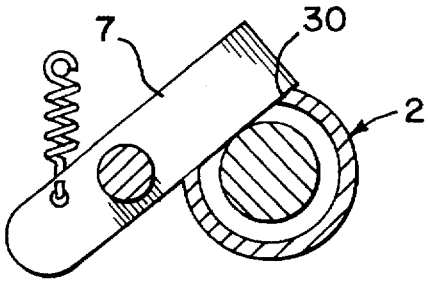

With reference to the FIGS. 1 denotes in its entirety a filler valve group of a container liquid filler machine 10. In the description, specific reference will be made to cans, but the invention can be applied to other kinds of containers.

The filler machine is conventionally of the rotating platform type 6 equipped with a plurality of filler groups.

A lifting group 2 is associated to each valve group 1 and supports a plate 5 destined to receive a can 10. In the examples in FIGS. 1 to 7, a cam 15 regulates, by means of a roller 16, the vertical movement of the plate 5 coaxially to valve group 1. A mechanical pivot 7 can block the lifting group 2 in the position defined by the cam 15, by inserting into a recess 30 in the lifting group 2.

The lifting group 2 constitutes a lifting means of the can 10 towards the valve group 1.

The valve group 1 comprises an obturator or valve 11 in the shape of a tubular stem, which regulates the influx of liquid in a pipe 12, from a container tank 29 to the can 10. Apart from the filling liquid, there is also a pressurised gas in the tank 29, occupying the free space above the liquid.

A spring 19 regulates the aperture of the valve 11, pushing it upwards and freeing the pipe 12.

The valve 11 is housed in a cylindrical housing 17 and is internally hollow. Gas or return air passes through the internal pipe 13 of the valve 11, the flow of which is regulated by a valve 9 activated by a mechanical positioner 8. The internal pipe 13 is made entirely internally to the tubular stem of the valve 11 and opens at the inferior end of the tubular stem.

The valve group 1 is inferiorly provided with a centering element 3 which sealingly engages the mouth of the can by means of a gasket 4.

The centering element 3 can rise externally to the valve group 1, together with the can, so that the inferior end of the valve group 1 can penetrate into the can 10 itself.

With particular reference to FIG. 1, where in letters A to H the various operative phases of a filling cycle are shown, in the diagrams below the main illustrations the angular positions of the rotating platform 6 corresponding to the single phases are shown. The process of the invention envisages the following operative phases:

A—The empty can 10, entering the filler machine, is positioned on a plate 5 of the lifting group 2 coaxial to the valve group 1, the plate 5 being at the bottom dead center and the centering element 3 being raised so as to enable the can 10 to be positioned below it. Then the centering element 3 lowers on to the can 10, as can be seen in the figure, up until the mouth of the can 10 couples with the gasket 4 of the centering element 3.

Figure 6:
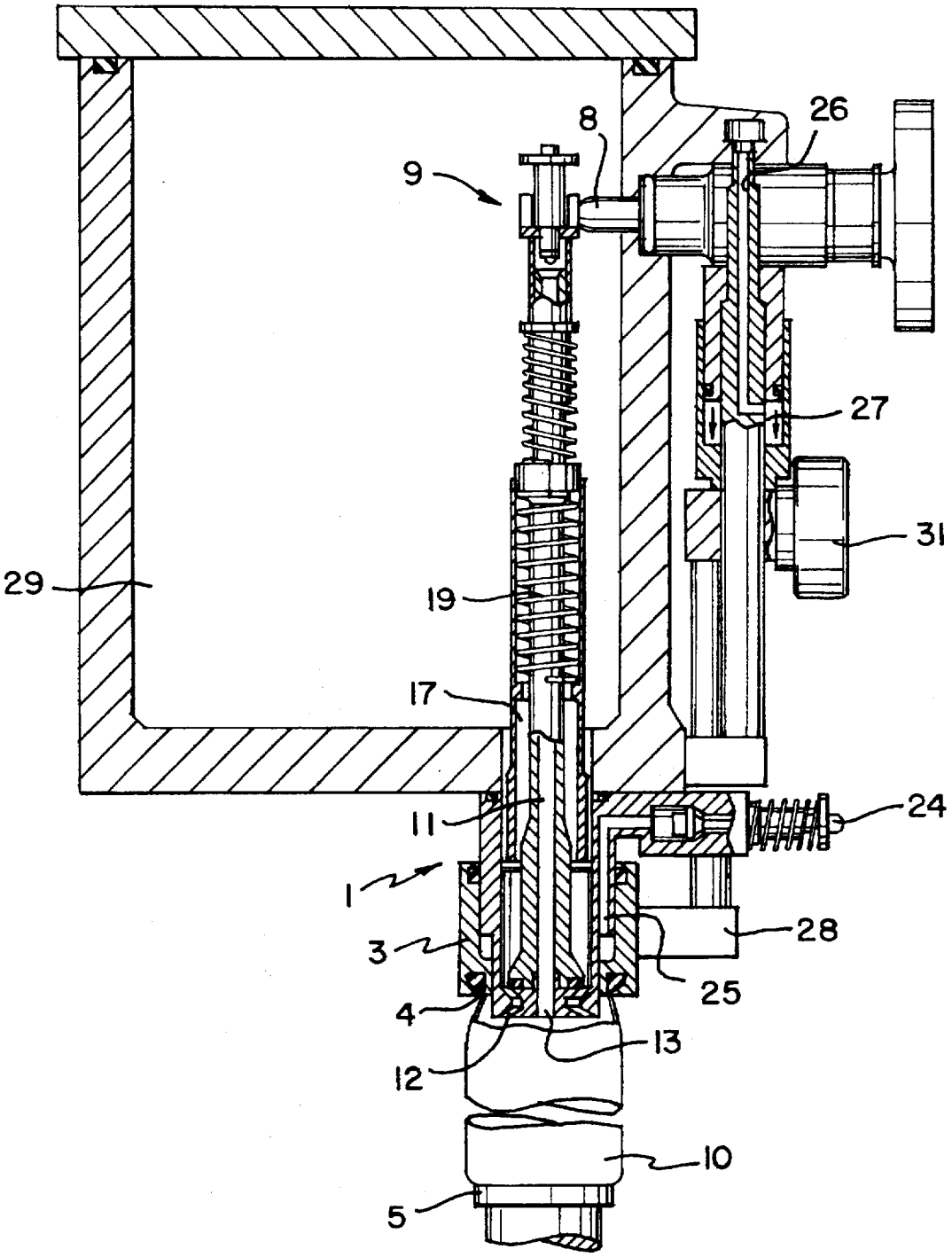
FIG. 6 shows, in vertical section, a filler valve group.

B—The cam 15, through the lifting group 2, causes the can 10 to rise, together with the centering element 3, externally to the valve group 1, which thus penetrates inside the can 10. In the meantime, the mechanical pivot 7 blocks the lifting group 2 in the position defined by the cam 15. A mechanical force acting in the direction of arrows 18 keeps the centering element 3 pushed downwards, in order to preserve the seal between the centering element 3 and the can 10. The force, as is illustrated in FIG. 6, is realised by the immission of compressed air into a pipe 26 which opens into a chamber 27 so as to push a support 28 of the centering element 3 downwards.

In a further embodiment (not illustrated) the downwards push exerted on the centering element 3 is obtained by using special elastic means, such as for example springs.

C—The activation of the mechanical positioner 8 causes the gas valve 9 to open and when the pressure inside the can 10 is equal to that in the tank, the spring 19 causes the valve 11 to raise and the consequent inflow of liquid into the can 10 through the pipe 12, while the gas returns into the tank through the internal pipe 13.

Both ends of the pipe 12 and internal pipe 13 are at the same level.

D—When the liquid in the can 10 reaches a predetermined level (coinciding with the inferior end of the internal pipe 13), indicated in the figure by arrow 20, which is below the final level desired, the inflow of liquid stops as it closes both the internal pipe 13 and the pipe 12.

E—The pivot 7 reenters and frees the lifting group 2 which then can descend along a lowering cam 14, with the gas valve 9 and the valve 11 still open.

F1—Mechanical closure of the gas valve 9 and the valve 11 by activation of the positioner 8 and with the liquid (denoted by arrow 21) reaching its desired level in the can 10, which level is above that of phase D since during the can's descent, with the gas valve 9 and the valve 11 still mechanically open, the pipe 12 and internal pipe 13 positions have risen in relation to the can 10. The positioner 8 command is external to the machine, and is fixed and single for all of the valve group 1.

F2—This phase of the cycle shows the extreme simplicity with which a change in the level of the liquid, and thus the quantity of contents in the can, are obtained.

It is enough to change the mechanical closing point of the valve 9 and the valve 11 along the inclined tract of the lowering cam 14 to obtain a different level. In the illustrated case, the difference between the level indicated by an arrow 22 and the preceding level indicated by arrow 21 is equal to the lowering of the lifting group 2 indicated by arrow 23.

In a further embodiment (not illustrated) the filling level change can be obtained by changing the inclination of the lowering cam 14, and keeping the positioner 8 intervention point fixed. This happens by using special means, constituted for example by a lowering cam 14 pivoted at one of its ends while its other end is adjustable to various height levels.

G—After being closed as in F1 or F2, the lifting group 2 follows its lowering journey along the cam 14; the valve group 1 is removed from the can 10, increasing the free volume and initialising the decompression of the can without placing the free space in communication with the outside atmosphere. At the end of the this phase the residual pressure value in the can depends on the filling pressure value.

The can decompression continues with the activation of a button 24 which causes the opening of a valve that places the inside of the can in communication with the outside atmosphere through a pipe 25 opening at one end inside the centering element 3 and at the other end into the external atmosphere.

H—The lifting group 2 returns into a position at the lower start-cycle level and the centering element 3 is partially raised by a cam acting on a roller 31 to permit the can to exit from the filler machine.

Figure 7:
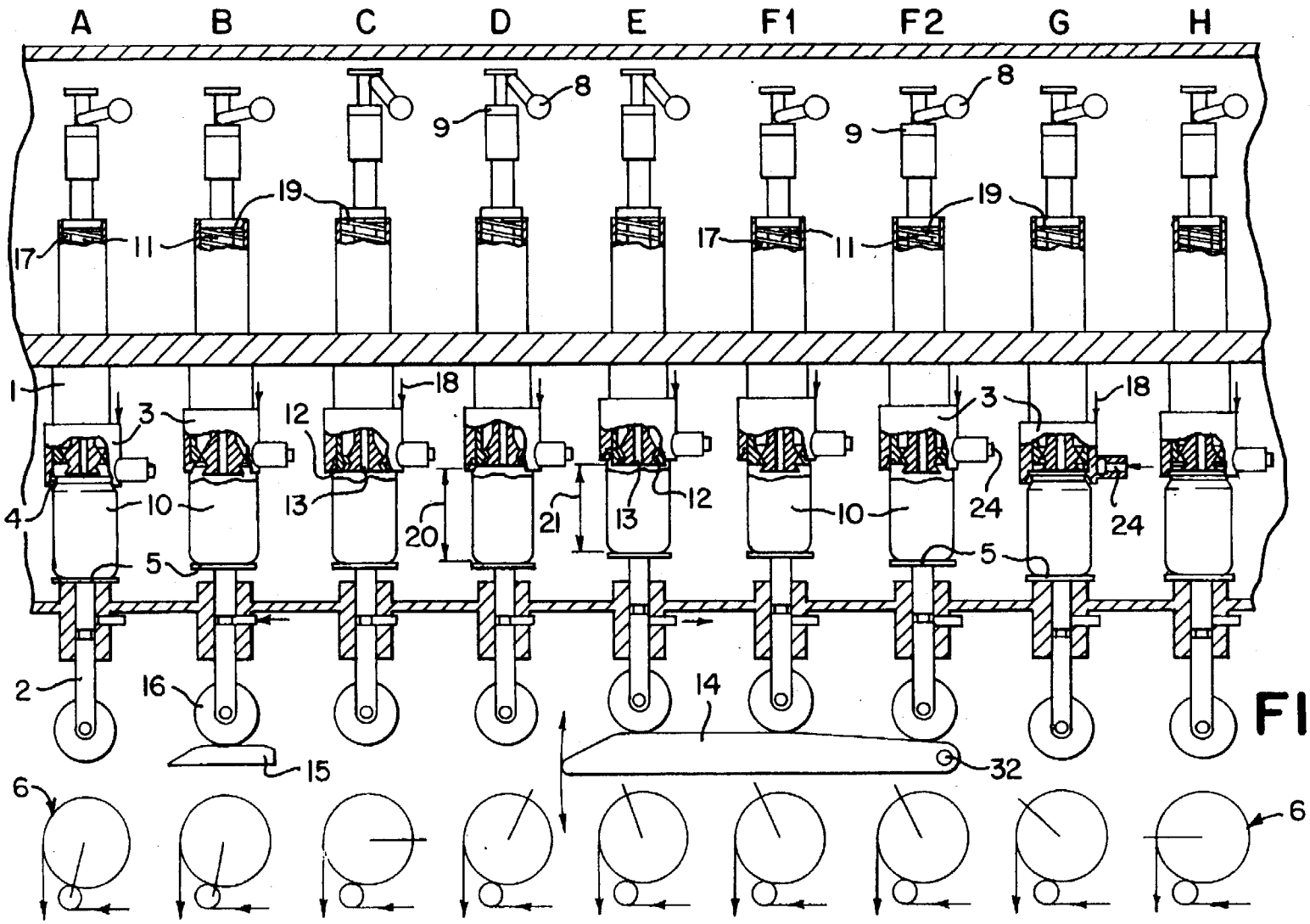
FIGS. 7 and 8 show the various phases of the process according to two different operative sequences.

With reference to the process variation illustrated in FIG. 7, phases A, B, C and H stay the same, while the other phases are substituted by the following:

D—When the liquid in the can reaches a prefixed level (coinciding with the inferior end of the internal pipe 13), denoted in the figure by an arrow 20 and above the final desired level, the inflow of the liquid stops since it closes both the internal pipe 13 and the pipe 12.

E—The pivot 7 reenters and frees the lifting group 2 which is pushed upwards by means of a cam 14, with the gas valve 9 and the valve 11 still mechanically open.

The excess product flows back into the tank through the pipe 12 and thus a level correction is performed, the liquid in the can 10 now being at the desired level, indicated with an arrow 21, the level being lower than that of phase D.

It is enough to change the height position of the cam 14 pivoted at 32 to obtain, with extreme simplicity, a corresponding change in the can liquid level.

In a possible further embodiment (not illustrated) the cam 14, rather than being pivoted at 32 can translate in height parallel to itself to obtain a change in the level of liquid in the can.

F1—Mechanical closure of the gas valve 9 and the valve 11 (at the macimum upper point of the cam 14 by means of activation of the positioner 8.

F2—After closure at F1 the lifting group 2 follows a descent course along cam 14; the valve group 1 disengages from the can 10, thus increasing the free volume and initialising the can decompression without placing the free space in communication with the outside atmosphere. At the end of this phase the residual pressure value in the can 10 depends on the filling pressure value.

G—The can decompression continues by means of the activation of a button 24 which causes opening of a valve placing the inside of the can 10 in communication with the outside atmosphere through a pipe opening at one end inside the centering element 3 and at the other end into the outside atmosphere.

Figure 8:
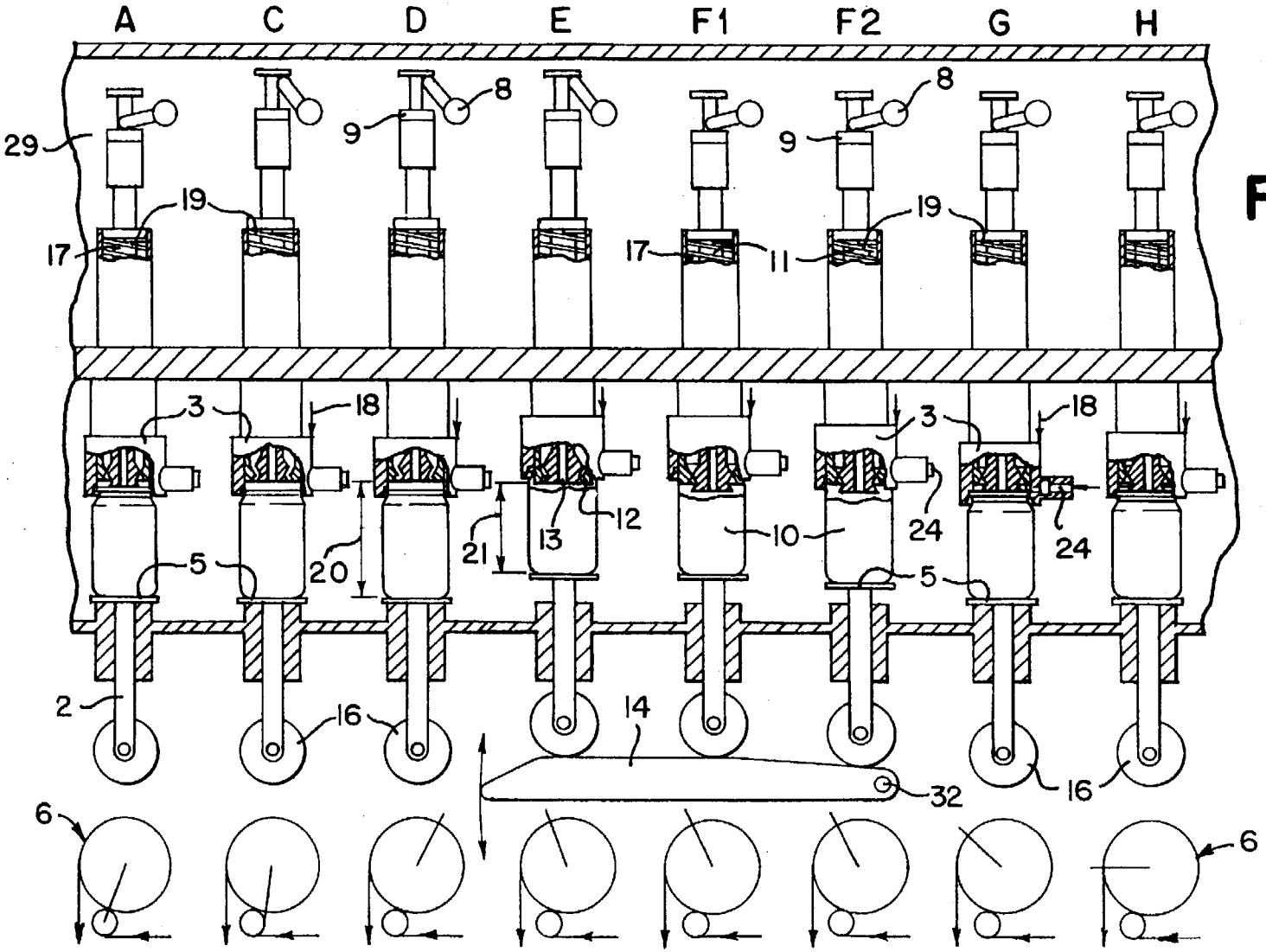

In FIG. 8 a further phase sequence of the process is shown, wherein, with respect to the sequence of FIG. 7, phase B is missing and thus the can 10 is not lifted by the lifting group 2, nor blocked by the pivot 7, since the pivot 7 and the lifting cam 15 are absent: the filling occurs with the can in a not-raised position with respect to the loading plane.

In this case phases C and D are substantially the same as the preceding case, as are phase E (except that the pivot is missing) and phases F1, F2, G and H.

The absence of the level-sensing tube from the invention, being replaced by a gas pipe 13 which is completely internal to the valve 11 of the liquid influx pipe, permits of avoiding the problems connected with the use of the sensing tube and ensures greater precision in the filling levels, as the liquid contemporaneously closes both the internal pipe 13 and the pipe 12, thus preventing further inflow of the product into the can 10.

In a further embodiment (not illustrated) the inferior end of the gas internal pipe 13 can be at a higher level with respect to the inferior level of the liquid pipe 12.

A great advantage is that the level of the product in the cans can be changed by a single command, external to the filler machine: this is a rapid and reliable operation if we compare it to the traditional substitution of single level sensing tubes for each valve group 1.

The decompression of the can created by the increase in the free space determined by the descent of the can with respect to the valve group 1 permits of large reduction in counterpressure gas consumption, smaller loss of gas into the atmosphere and less foam.

A reduction in the foam can be obtained also by means of the correction of the level effected in phase E of FIGS. 7 and 8, by making it so that the liquid level is corrected by reduction rather than increase, with a partial reflow of the excess liquid into the tank.

The initial more-or-less total filling of can brings about a natural limitation of foam formation as well as a more precise correction.

The absence of syphons or nets or small holes along the liquid inflow pipe in order to avoid the overfilling of the can 10, allows larger inflow volumes to be introduced and therefore decrease filling time.

What is claimed:

1. A process for filling containers, in particular cans, comprising phases of:

establishing a sealed coupling between a mouth of a container and a filler valve group, including a lifting of the container towards the filler valve group;

opening a gas valve and a liquid valve and subsequently closing said valves once a filling operation has been effected; during said opening an inferior end of a gas inflow pipe is positioned at a same level as an inferior end of a liquid inflow pipe, or at a higher level with respect thereto, such that when a liquid level in the container reaches and closes the liquid inflow pipe, the liquid level also closes the gas pipe, or respectively the gas pipe remains open;

separating the container from the valve group;

wherein when the liquid level in the container reaches at least the liquid pipe, when the gas valve and the liquid valve are still mechanically open, a liquid level correction phase in the container occurs, by means of a gradual and adjustable change in a height position of the container with respect to the valve group, the size of the change being in accordance with a required level of liquid in the container.

2. A process as in claim 1, wherein the liquid level correction phase occurs by raising the container with respect to the valve group to a degree which is in accordance with the required level of liquid in the container.

3. A process as in claim 1, wherein the liquid level correction occurs by means of a gradual and adjustable descent of the container with respect to the valve group, a degree of said descent being in accordance with the desired liquid level in the container.

4. A process as in claim 1, wherein, after closing the gas valve and the liquid valve, the container is made to descend gradually and adjustably with respect to the valve group, a resultingly increased free volume causing a decompression internally to the container.

5. A filler valve group for a filler machine of containers, in particular cans, comprising:

a valve, shaped as a tubular stem for a liquid inflow pipe, to regulate a liquid inflow from a tank into a container arranged coaxially below the valve;

a valve including a pipe for gas or air, said pipe being at least partially internal to the tubular stem during a filling phase and having an opening at an inferior end thereof, or at a higher position thereof, adjacent said valve for gas or air;

wherein a cam is provided which regulates the descent of the container with respect to the valve group so that by means of a retarded or anticipated activation of a positioner which closes the pipes and a correspondingly higher or lower final level of liquid in the container is achieved.

6. A valve group as in claim 5, wherein a mobile centering element is provided, which surrounds the inferior end of the valve group, and is normally loaded in a downwards direction and creates a seal with a mouth of the container when the container is pushed towards the centering element by a lifting group causing raising of the centering element about the valve group, and a partial insertion of the tubular stem in the container.

7. A filler valve group as in claim 6, wherein the lifting group, activated by a cam, has a mechanical pivot to block the lifting group in a work position.

8. A filler valve group as in claim 5, wherein the positioner has a command external to the filler machine and is unique for all of the valve groups of the filler machine, and opens or closes the gas valve and closes the liquid valve.

9. A filler valve group as in claim 5, wherein said cam which regulates the movement of the container with respect to the valve group has means which permits regulation of an inclination of the cam with respect to a horizontal plane.

10. A filler valve group in a filler machine of containers, in particular cans, with liquids, comprising:

a valve, shaped as a tubular stem for a liquid inflow pipe, to regulate a liquid inflow from a tank to a container arranged coaxially below the valve;

a valve including a pipe for gas or air, said pipe being at least partially internal to said tubular stem during a filling phase and having an opening at an inferior end thereof, or a higher position thereof, adjacent said valve for gas or air;

wherein a cam is provided which regulates the ascent of the container with respect to the valve group with the valves still mechanically open in such a way that liquid flows back into the tank through the pipe performing a level reduction correction of the liquid in the container.

11. A filler valve group as in claim 10, wherein said cam which regulates the movement of the container with respect to the valve group has means which permits regulation of an inclination of the cam with respect to a horizontal plane.

12. A valve group as in claim 10, wherein a mobile centering element is provided, which surrounds the inferior end of the valve group, and is normally loaded in a downwards direction and creates a seal with a mouth of the container when the container is pushed towards the centering element by a lifting group causing raising of the centering element about the valve group, and a partial insertion of the tubular stem in the container.

13. A filler valve group as in claim 12, wherein the lifting group, activated by a cam, has a mechanical pivot to block said lifting group in a work position.

* * * * *